United States Patent [19]

Richey

[11] Patent Number: 4,601,693

[45] Date of Patent: Jul. 22, 1986

[54] APPARATUS FOR CRIMPING A MOVING WEB

[75] Inventor: Jarold L. Richey, Dayton, Ohio

[73] Assignee: Harris Graphics Corporation, Melbourne, Fla.

[21] Appl. No.: 674,614

[22] Filed: Nov. 26, 1984

[51] Int. Cl.[4] ..... B05B 49/00

[52] U.S. Cl. ..... 493/370; 493/365; 493/381; 83/876; 83/883; 270/53

[58] Field of Search ..... 493/364, 365, 367, 368, 493/370, 417, 381, 390, 363; 83/345, 876, 883; 270/53, 37; 282/11.5 A

[56] References Cited

U.S. PATENT DOCUMENTS

| | | | |
|---|---|---|---|
| 2,328,081 | 8/1943 | Johnson | 282/11.5 A |
| 3,303,083 | 2/1967 | Hedenstrom | 282/11.5 A |
| 3,475,249 | 10/1969 | Smith, Jr. | 282/11.5 A |
| 4,114,869 | 9/1978 | Gladon et al. | 270/53 |
| 4,422,630 | 12/1983 | Trentman | 493/370 |
| 4,426,242 | 1/1984 | Sarkans et al. | 282/11.5 A |

FOREIGN PATENT DOCUMENTS

| | | | |
|---|---|---|---|
| 959071 | 5/1964 | United Kingdom | 282/11.5 A |

*Primary Examiner*—Francis S. Husar
*Assistant Examiner*—David B. Jones
*Attorney, Agent, or Firm*—Biebel, French & Nauman

[57] ABSTRACT

Apparatus for crimping of a moving web is provided, the web having a plurality of holes formed therethrough along a line defined thereon in the direction of movement of the web, each of the holes being separated from a preceding hole by a substantial uniform distance. A holder for mounting a plurality of crimp blades is secured to a shaft for rotation thereby, and the blades are mounted to the holder body in predetermined fixed locations. An anvil is also provided, mounted to a second shaft for rotation thereby. The anvil body includes at least one annular groove defined around its outer surface for receiving the cutting edges of the blades, counter-rotation of the holder and anvil with the moving web therebetween causing insertion of each blade at least partially through the web and into the groove, and subsequent withdrawal of the blade, thereby crimping the web. A plurality of pins are mounted to the holder body so as to extend radially therefrom, and a plurality of holes are defined within the anvil body through its outer surface such that as the holder and anvil are counter-rotated, each of the pins engages and subsequently disengages one of the holes. The pins and holes are located on the holder and anvil, respectively, such that each of the pins further engages and subsequently disengages one of the holes of the web as the web moves between the holder and anvil.

4 Claims, 10 Drawing Figures

.25
.50
.50
.25

104
124
126
138
146
140
142
20
108
136
134
112
114
133
110
144
130
106
132
128
122
108'
20'
140
142
141
138
120
118
116
M

APPARATUS FOR CRIMPING A MOVING WEB

BACKGROUND OF THE INVENTION

The present invention relates generally to the crimping of a moving multi-layer paper web at a plurality of locations along its length by a plurality of blades. More particuarly, the invention relates to a crimp blade holder mounting the blades and a cooperating anvil that are specifically adapted to insure that the various layers of the web remain in proper registration during crimping. Such devices are particularly useful in machines for collating several paper webs, such as might be done in the manufacture of business forms.

Multi-layer, preprinted business forms are commonly used, for instance, where it is desired to make multiple copies of a document at the same time. In manufacturing such forms, a single layer web is printed for each layer of the form, and the individual webs are then supplied to a collator for proper arrangement into layers. Normally, after collating, a perforation is provided across the webs at a plurality of predetermined locations, so that individual forms may be separated from the web for use. The individual forms typically are not separated until immediately before or after use, and the forms are packaged for shipment and/or storage by folding the web in accordion-like fashion along the perforations.

The separation between consecutive perforations along the web is, of course, determined by the desired length for the form. In the United States, the two most common lengths for forms are 8½" (21.6 cm) and 11" (27.9 cm), and in Europe, the most common lengths are 8" (20.3 cm) and 12" (30.5 cm).

In addition to the perforations provided across the multi-layer web, the web is further provided with a series of holes along each of its edges. These holes may be used for advancing the web, both during manufacture of the forms, and during their use, for instance, where the individual forms are prepared using a computer-driven printer. Typically, the holes are disposed along the edge of the web at a spacing of 0.50 inch (1.27 cm) center-to-center, and equipment used with forms has been designed to be compatible with such spacing.

In order to keep the various layers of the form together until such time as it is desired to separate them, it is common to provide a pluality of crimps along each edge of the multi-layer web during collating. The crimping is normally performed by a series of crimp blades, each of which has a plurality of fingers for cooperating with grooves provided in an anvil surface. The fingers puncture and pass through the web into the grooves of the anvil surface, thereby providing a plurality of slots through the layers of the web. The crimp blades are designed, however, such that the small portions of the paper layers orginally located where the slots are formed are not severed from the web, but rather are pushed downwardly through the slot formed in the underlying layers. These small portions of paper thus serve to hold the various layers together.

The crimp blades are usually mounted to one or more blade holders, an example of which is disclosed in U.S. Pat. No. 2,935,002, issued May 3, 1960 to Robinson, which in turn are mounted to a rotatable shaft. The multi-layer web is passed between the blade holders and the cooperating anvil surface, and the blade holder shaft is rotated at a speed such that the fingers of the crimp blades and the web approach each other at the same linear speed. Thus, as the web is passed by the blade holders, the blades crimp the web in a pattern predetermined by the arrangement of the blades along the holders.

To be effective, the crimps must be located along the web so as to avoid the holes. Accordingly, as can be seen in FIG. 1, the crimps are typically centered 0.25 inch (0.635 cm) from the centers of adjacent holes, and are therefore separated from other crimps by an integer number of half-inches.

The perforations separating successive forms represent yet another constraint on the location of the crimps. The perforations must be located so as not to fall on the holes, and thus, as seen in FIG. 1, are also located 0.25 inch (0.635 cm) from the centers of adjacent holes. It is not desirable, however, for the crimps to fall along a perforation. In such a case, the crimps could cause premature, partial separation of individual forms along the perforation, thereby making accidental full separation much more likely. Moreover, the crimps prevent even, neat folding along the perforations, interfering with the proper arrangement of the web for storage and/or shipping.

In a typical forms collating machine, such as that shown in U.S. Pat. No. 2,859,035, issued Nov. 4, 1958 to Franzmann, or U.S. Pat. No. 3,727,908, issued Apr. 17, 1973 to Whitesell et al, the various individual web layers are assembled along one or a series of pin conveyors, each of which provides an endless belt having a plurality of pins thereon for engaging the holes along the edges of the layers. These pins serve the dual function of moving the web through the collating machine and placing and maintaining each of the individual layers in proper registration as it is added to the multi-layer web moving therethrough. This latter function is important, since over the web path length along the length of the conveyor, which may be in the order of 10 feet (3.05 m), the cumulative tolerance in any one layer of the spacing between the holes may be as great as ±3/32 inch (0.238 cm).

The pin conveyor releases the web prior to its passage between the blade holders and anvils for crimping. Following the application of crimps to the web, a second pin conveyor engages the crimped web for further movement through the collator machine. In order to permit engaging of the pins with the holes in the assembled web, it is necessary for a clear hole of at least 0.125" (0.318 cm) to be maintained through the various web layers, and thus it is important for the web layers to be in proper registration.

Despite the noted cumulative tolerance between the holes of each layer, the pins of the conveyor maintain the various layers in registration. This may then result in a small amount of "bubble" between individual layers, but the distribution of such bubble over the length of the web results in it being insignificant insofar as subsequent use of the finished forms is concerned. Nonetheless, it can be seen that the bubble represents an unstable condition with respect to web registration, although the bubbled condition is maintained by engagement of the pins with the holes along the web.

Once the pins release a portion of the web for passage thereof between the crimp blade holders and anvils, the maintenance of that particular portion of the web in registration is discontinued. Thus, any forced bubbling that was introduced for proper registration can dissipate, resulting in movement of one or more of the web layers out of registration. Moreover, even in the case of relatively stable bubbling, passage of the web between the blade holders and anvils will cause flattening of the bubble, thereby further moving the web layers out of registration. This latter problem is present even when bubbling of the web results from causes other than variations in hole spacing. Further, of course, once crimps are applied to the web, any misregistered layers will be secured in such a position, thereby preventing the layers from being reregistered.

What is needed, therefore, is a means by which the various layers of a multi-layer moving web may be held in registration within a collator machine following assembly of the layers up to and through such time as crimps are applied to the web. Such a means would enable the web to be crimped while insuring sufficient clearance through the corresponding holes of each layer to permit subsequent movement of the web, both within the collator and in machines for later use of the forms, by engaging the holes with driven pins. Such a means should be relatively simple in design and operation and, importantly, should be capable of being retrofit onto existing machines without the need for modification or reconstruction thereof.

SUMMARY OF THE INVENTION

The present invention meets the needs set forth above by providing a holder for mounting a plurality of crimp blades for crimping of a moving web, the web having a plurality of holes formed therethrough along a line defined thereon in the direction of movement of the web. Each of the holes is separated from the preceding one by a substantially uniform distance.

The holder includes a cylindrical body having a curved outer surface, an axial hole being defined through the cylindrical body for mounting the body to a shaft. The body is secured to the shaft such that the body may be axially rotated thereby. The crimp blades are mounted to the body in predetermined fixed locations with respect to the outer surface such that rotation of the body causes the blades to crimp the web moving therepast. A plurality of pins are mounted to the body such that the pins extend radially from the outer surface. The pins are mounted to the body in a configuration to cause each of the pins to engage and subsequently disengage one of the holes of the web as the body is rotated and the web is moved therepast.

A corresponding anvil including a cylindrical anvil body having a curved outer surface may also be provided. An axial bore is defined through the cylindrical anvil body for mounting the anvil to a second shaft, with the anvil secured to the second shaft for rotation thereby. The anvil body has at least one annular groove defined around the outer surface thereof for receiving the cutting edges of the crimp blades. Counter-rotation of the holder body and the anvil body with the moving web therebetween causes insertion of each blade at least partially through the web and into the groove, and subsequent withdrawal of the blade, thereby crimping the web. The anvil is further provided with a plurality of holes defined within its outer surface such that as the holder and the anvil are counter-rotated, each of the pins mounted to the holder at least partially engages and subsequently disengages one of the holes. Such engagement and disengagement, of course, occurs simultaneously with engagement and disengagement of the pins with the holes provided along the web.

Accordingly, it is an object of the present invention to provide a means for maintaining the layers of a multilayer web in registration during crimping of the web; to provide a crimp blade holder and cooperating anvil that are specifically adapted for maintaining the web in registration; to provide such a holder that includes radially extending pins for engaging and disengaging holes provided in the web, along with such an anvil adapted to cooperate with the pins; and to provide such a holder and anvil that may be installed within new web handling machines or retrofit into existing machines.

Other objects and advantages of the present invention will be apparent from the following description, the accompanying drawings, and the appended claims.

DETAILED DESCRIPTION OF THE PREFERRED EMBODIMENT

Figures 2, 3, 4:
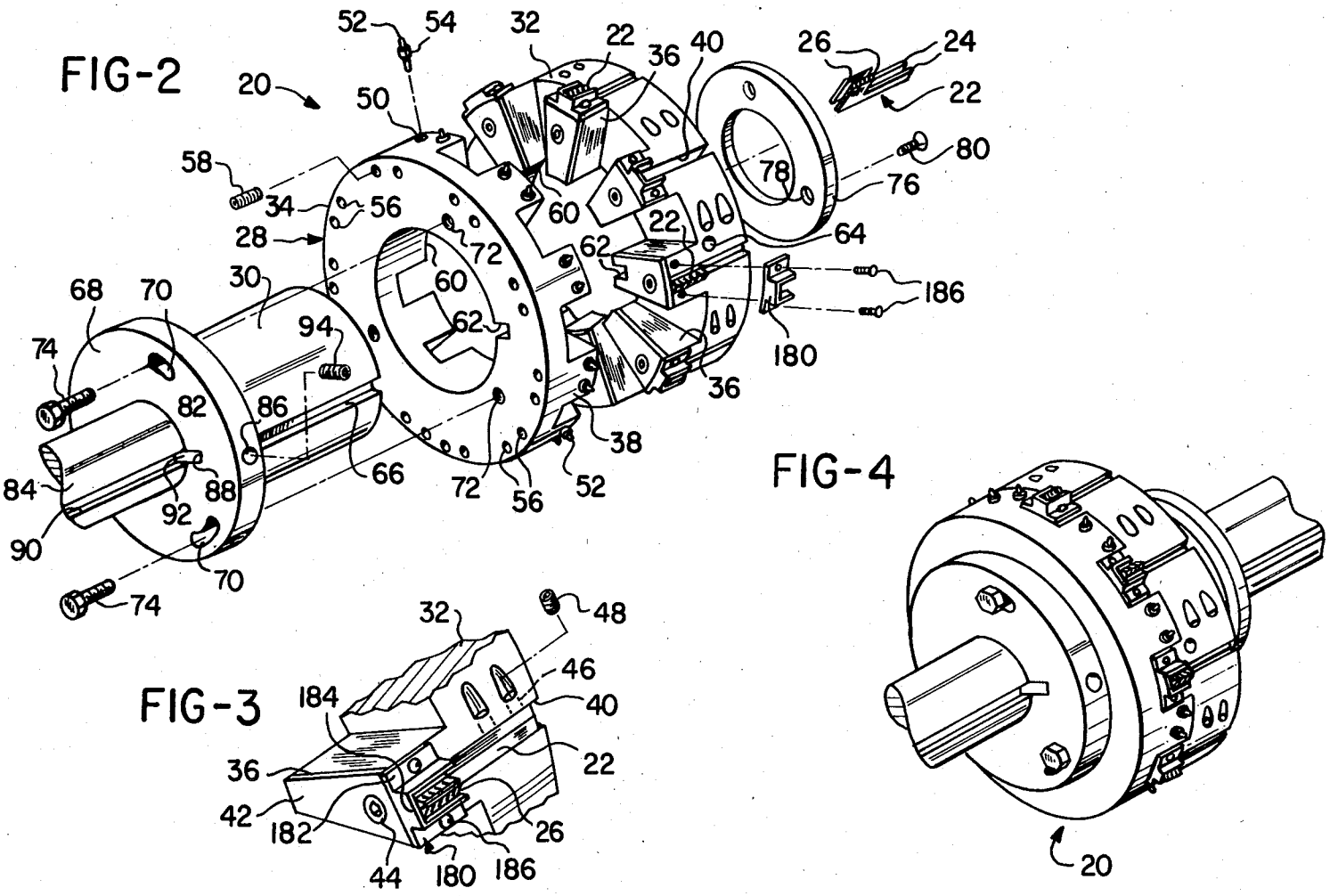
FIG. 2 is an exploded perspective view of a crimp blade holder of the present invention for crimping one edge of a web.
FIG. 3 is an enlarged view of a portion of the crimp blade holder of FIG. 2.
FIG. 4 is a perspective view of the crimp blade holder of FIG. 2, showing the holder in an assembled state.

Referring generally to the drawings, and in particular to FIG. 2, a crimp blade holder 20 is shown for removably mounting a plurality of crimp blades 22. Each of crimp blades 22 includes two halves 24 and is provided with a plurality of fingers 26 for crimping a web, the outermost tips of fingers 26 defining the leading edge of blade 22.

Blade holder 20 includes a cylindrical body 28 consisting primarily of three sections. A hub 30 is provided, on which is placed blade mounting portion 32 and pin mounting portion 34. Each of portions 32 and 34 includes a plurality of projecting blocks 36 and 38, which are appropriately sized so as to mesh for placement of portions 32 and 34 adjacent each other.

Blade mounting portion 32 is provided with a plurality of slots 40 located along the periphery of portion 32, with each slot 40 extending along one of the projecting blocks 36. A crimp blade 22 may be inserted into each of the slots 40. A plate 42 is attached by a bolt 44 to the end of block 36, thereby closing off one end of slot 40. Plate 42 provides for accurate positioning of a blade 22 within slot 40, with the blade 22 being inserted into slot 40 so as to abut plate 42.

Associated with each slot 40 is a pair of threaded bores 46 opening into the slot 40 through one of its side walls. Each bore 46 is oriented to intersect the side wall perpendicular thereto, and extends through the surrounding portion 32, opening along the periphery thereof. Each bore 46 is adapted to receive a set screw 48, which may be advanced or retracted along bore 46 by an appropriate tool, such as an allen wrench (not shown). When a crimp blade 22 is inserted into a slot 40, the set screws 48 disposed within the corresponding bores 46 are advanced and tightened against the blade 22, thereby clamping blade 22 firmly in place.

Pin mounting portion 34 is provided with a plurality of holes 50 located along the periphery of portion 34 in blocks 38. A pin 52 may be inserted into each of holes 50, each pin 52 including a flange 54 for providing accurate depth positioning of pin 52 within each hole 50.

Each of holes 50 is provided with a threaded bore 56 opening into hole 50 through its side wall. Each bore 56 perpendicularly intersects the side wall, and extends through the surrounding portion 34, opening along the side face thereof. Each bore 56 is adapted to receive a set screw 58, which may be advanced or retracted along bore 56 by an appropriate tool, such as an allen wrench. When a pin 52 is inserted into hole 50, the set screw 58 disposed within the corresponding bore 56 is advanced and tightened against the pin 52, thereby clamping pin 52 firmly in place.

Both of portions 32 and 34 include a central opening 60 for placement of the respective portion upon hub 30. A groove 62 is provided extending the full length of each opening 60 and a threaded bore 64 extends through portion 32, opening into its respective opening 60 through groove 62. A similar groove 66 is provided along hub 30, extending the full length of the outer surface thereof. Both groove 62 and groove 66 cooperate when portions 32 and 34 are mounted to hub 30 to form a keyway for proper positioning of portions 32 and 34 on hub 30. A key (not shown) is inserted into groove 66 of hub 30, and also fits into grooves 62 on portions 32 and 34. A set screw (not shown) engagable with threaded bore 64 is inserted into bore 64 and advanced toward and tightened against the key, thereby securing portion 32 in a desired position along hub 30.

Figures 1, 6:
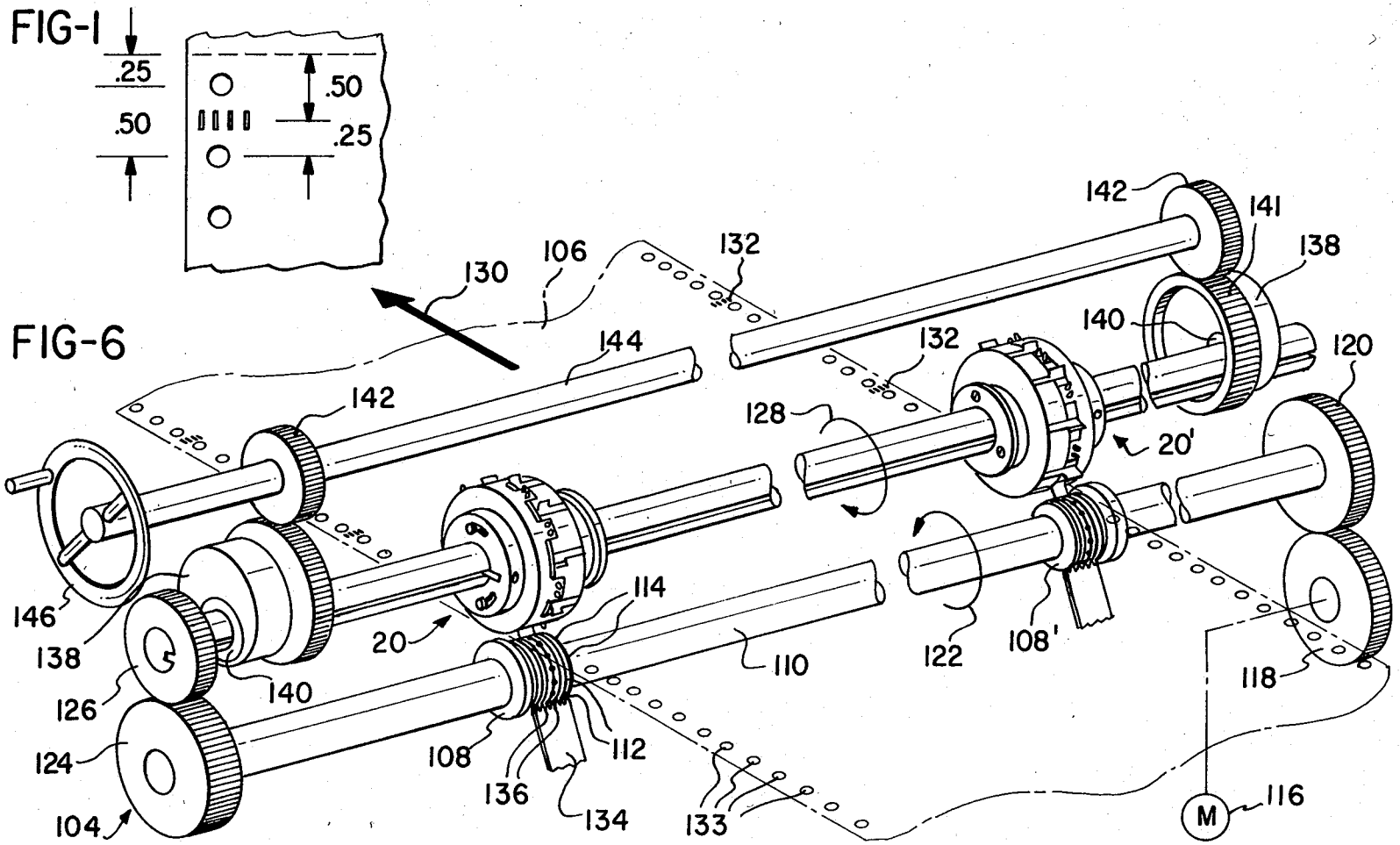
FIG. 1 is a plan view of a portion of a multi-layer paper web, showing relative spacings therealong of registration holes, a perforation, and a crimp, in which the dimensions presented are in inches.
FIG. 6 is a perspective, partially schematic view of an apparatus for crimping the edges of a paper web, including the crimp blade holders of the present invention.

In most instances, it will be desired to form the crimps on the web along a line defined by the pre-formed registration holes, such as is shown in FIG. 1. In such a case, portions 32 and 34 are mounted on hub 30 with blocks 36 and 38 meshed completely. It may be desirable in some cases, however, to form the crimps on the web along a separate line to the inside of the registration holes. By constructing holder 20 in portions 32 and 34, portion 32 may be moved inwardly with respect to the web along hub 30, thereby moving the positioning of crimps on the web.

Hub 30 includes a flange portion 68 attached along one end thereof that includes a plurality of openings 70 defined therethrough. A plurality of threaded bores 72 are defined in the side face of portion 34. Bolts 74, extendable through openings 70 for engagement with each of bores 72, secure portion 34 to hub 30.

A ring 76, provided with a plurality of openings 78, is fittable against the end of hub 30 opposite flange portion 68. A plurality of screws 80 are insertable through opening 78 and engagable with cooperating threaded bores (not shown) within the end surface of hub 30. The outer edge of ring 76 extends beyond the surface of hub 30, defining a flange thereabout, so that in the event portions 32 and/or 34 become loose upon hub 30, they will be retained thereon.

Hub 30 further includes an axial bore 82 formed through its entire length and sized accordingly such that a shaft 84 may be inserted therethrough for mounting holder 20. Hub 30 includes a threaded bore 86 extending radially through flange portion 68. A groove 88 is provided extending the full length of bore 82 through hub 30, and threaded bore 86 opens into bore 82 through groove 88. A similar groove 90 is provided along shaft 84, extending substantially the full length of shaft 84. Both grooves 88 and 90 cooperate when hub 30 is mounted to shaft 84 to form a keyway for proper positioning of holder 20 on shaft 84. A key 92 is inserted into groove 90 of shaft 84, and also fits into groove 88 of hub 30. A set screw 94, engagable with threaded bore 86, is inserted into bore 86 and advanced toward and tightened against key 92, thereby securing hub 30 in a desired position along shaft 84.

Blade holder 20 is shown in assembled form in FIG. 4.

Figure 5:
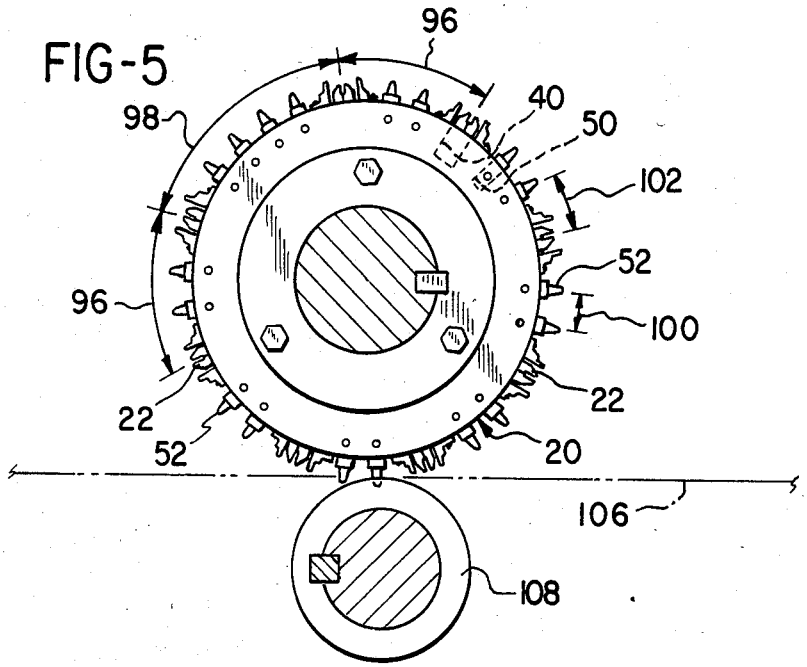
FIG. 5 is an end view of the crimp blade holder and a corresponding anvil surface member.

The relative spacing between adjacent slots 40 disposed along the periphery of blade holder 20 for mounting blades 22 can be seen in FIG. 5. The eight slots 40 are arranged such that the distance between all but one of any adjacent pair of blades 22 along a circle defined by the centers of the pitch line of blades 22 when mounted within slots 40, as indicated generally by arrows 96, is 2 inches (5.08 cm). One adjacent pair of blades 22, however, are arranged such that the distance between the adjacent pair along the described circle is 3 inches (7.62 cm). Thus, blades 22 inserted into slots 40 will produce a series of eight crimps along a web having a center to center spacing of 2.0, 2.0, 2.0, 2.0, 2.0, 2.0, 2.0, and 3.0 inches (5.08, 5.08, 5.08, 5.08, 5.08, 5.08, 5.08 and 7.62 cm) between adjacent crimps.

A similar blade mounting arrangement producing the same crimp spacing is disclosed in commonly-assigned U.S. patent application Ser. No. 534,514 filed Sept. 21, 1983 by Gaspar.

Holes 50 for mounting pins 52 are disposed along the periphery of blade holder 20 so that the pins 52 will cooperate with preformed registration holes along a web moving past holder 20. As has been indicated, such holes are customarily formed at a relative center-to-center spacing between adjacent registration holes of 0.50 inch (1.27 cm), and holes 50 are arranged such that the distance between an adjacent pair of pins 52 such as those indicated by arrow 100 is 0.50 inch (1.27 cm). Moreover, since the crimps are to be applied to the web so as not to coincide with the location of registration holes, a hole 50 for mounting a pin 52 that is adjacent to one of the crimp blades 22, indicated for example by arrow 102, is spaced so as to mount the pin 52 at a distance from the adjacent crimp blade 22 of 0.75 inches (1.90 cm).

It will be noted that, with the relative spacing between a pin 52 and an adjacent pin 52 or crimp blade 22 as described above, two holes 50 for mounting pins 52 will be located between most pairs of adjacent crimp blades 22 such as those indicated by arrows 96. Between the pair of adjacent crimp blades indicated by arrow 98, however, four holes 50 are provided.

The apparatus 104 with which blade holder 20 is used for crimping a moving web is shown in schematic fashion in FIG. 6. A pair of blade holders 20 and 20' are mounted to shaft 84 for providing crimps along both edges of a moving web 106. It will be recognized by comparing blade holder 20 and blade holder 20' that the holders include both a left hand holder 20 and a right hand holder 20'. While these holders are generally of identical construction, positioning of key ways 62 on the portions 32 and 34 of each blade holder are located so that the blade holders 20 and 20' are mounted to shaft 84 with relative circumferential positioning such that identical crimping patterns are produced on each edge of web 106 without any phase difference therebetween.

Blade holders 20 and 20' are further distinguished by the direction from which threaded bores 46 approach the blade mounting slots 40. By providing these variations in blade holders 20 and 20', it can be seen that an operator can manipulate set screws 48 in either blade holder for insertion or removal of blades 22 from the same side of shaft 84.

A pair of anvil surface members 108 and 108' are provided mounted to a rotatable shaft 110. Each anvil surface 108 and 108' is provided with a plurality of annular grooves 112 adapted such that fingers 26 of blades 22 will fit into grooves 112. Additionally, a series of bores 114 are located in a spaced relationship circumferentially around the grooved surface of anvil members 108 and 108'. Each bore 114 is of a size appropriate for receiving one registration pin 52 mounted to the corresponding blade holder 20 or 20' as shafts 84 and 110 are counter-rotated. Bores 114 are provided with a center-to-center spacing between adjacent bores of 0.50 inch (1.27 cm), and the blade holder 20 or 20' and the corresponding anvil surface 108 or 108' are mounted in an original registration such that pins 52 will be received into bores 114.

Shaft 110 is driven at one end by motor 116 through gears 118 and 120, in a direction indicated by arrow 122. A gear 124 is mounted to the opposite end of shaft 110, and engages a gear 126 mounted to one end of shaft 84. Thus, motor 116 and gears 118 and 120 also drive shaft 84, rotating it in a direction indicated by arrow 128.

Web 106 is passed between shafts 84 and 110 in tne direction indicated by arrow 130. During the crimping operation, shafts 84 and 110 are spaced such that fingers 26 of blades 22 mounted to blade holders 20 and 20' engage the annular grooves of anvil surface members 108 and 108'. Web 106 is passed along anvil surface members 108 and 108', and fingers 26 of blades 22 perforate web 106, providing a plurality of crimps 132 along the edges of web 106. Simultaneously, pins 52 engage holes 133, already formed along both edges of web 106, and bores 114 in anvil surface members 108 and 108', thereby maintaining each layer of the web 106 in proper registration as it passes between the blade holders and anvil surface members. Moreover, since pins 52 hold the web layers in registration during crimping, and the crimps fix the layers in their registered positions, the web layers remain registered following crimping.

Gears 118 and 120 and gears 124 and 126 are appropriately selected so that the surfaces of anvil surface members 108 and 108', the fingers 26 of blades 22, and pins 52 are rotated with a linear speed equal to the speed of the moving web 106.

At this point, it should be noted that pins 52 may be constructed from any appropriate rigid material, for example, steel. However, in the preferred embodiment, pins are molded from a nylon material. Not only are the pins thus quite economical to produce, but are advantageous in the event of any inadvertent misalignment between the blade holder 20 and anvil member 108. In such a case, pins 52 may not engage bores 114, whereupon the pins will simply be broken off, and can be subsequently replaced. If the pins were to be made, for example, from steel, failure of the pins to engage bores 114 could result in structural damage to holder 20, member 108, or other parts of the apparatus 104.

Each anvil surface member 108 and 108' is provided with a cleaner 134 disposed adjacent member 108 on a side opposite web 130. Each cleaner 134 has a plurality of fingers 136 extending one each into each of the annual grooves 112 of member 108 or 108'. Fingers 136 act during rotation of members 108 and 108' to clear any paper dust or other debris from grooves 112.

In order to initially thread web 106 through apparatus 104, or to replace or service any of the blade holders, crimp blades, registration pins, and the like, it is necessary to move blade holders 20 and 20' so that blades 22 and pins 52 are out of engagement with web 106. In order to disengage the blades and pins, advance of web 106 is halted. Shaft 84 is then raised away from web 106, thereby raising blades 22 and pins 52 from anvil surface members 108 and 108' and disengaging gears 124 and 126.

In order to raise and lower shaft 84, a pair of eccentric bearing housings 138 are provided near each end of shaft 84. Bearings 140 are mounted into each housing 138 so that shaft 84 is freely rotatable within the housings 138, which in turn are journalled to a support frame (not shown). A gear 141 is mounted concentrically to an end of each housing 138. A pair of gears 142, mounted to a shaft 144, engage gears 141. Shaft 144 may be rotated by a handle 146 or the like, so that rotation of handle 146 rotates gears 141 and thus housings 138, raising and lowering shaft 84. Blades 22 and pins 52 are thereby moved into and out of operating position.

Figure 7:
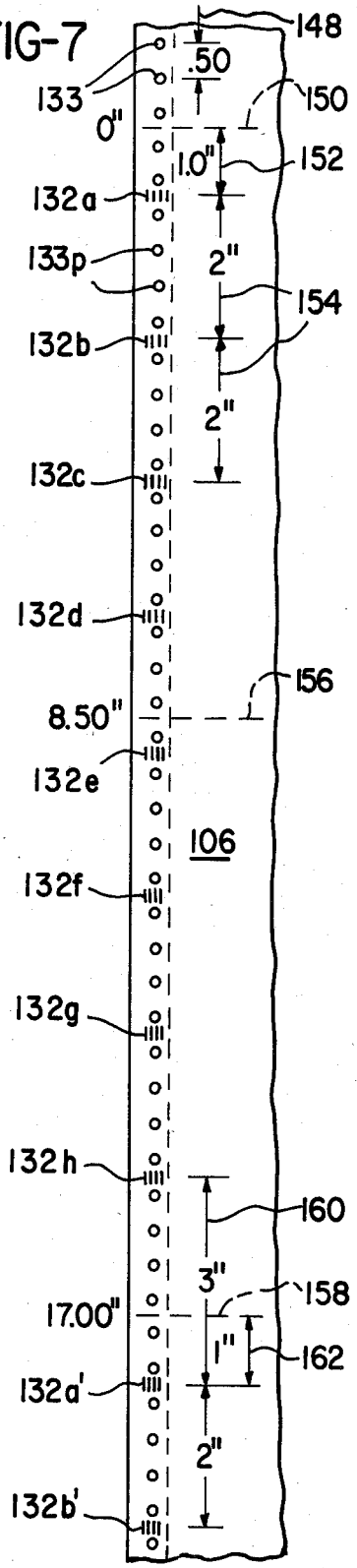
FIG. 7 is a plan view of a portion of a multilayer web showing the locations of crimps produced by the crimp blade holder along a series of 8½ inch (21.6 cm) forms, in which the dimensions are shown in inches.
Figure 8:
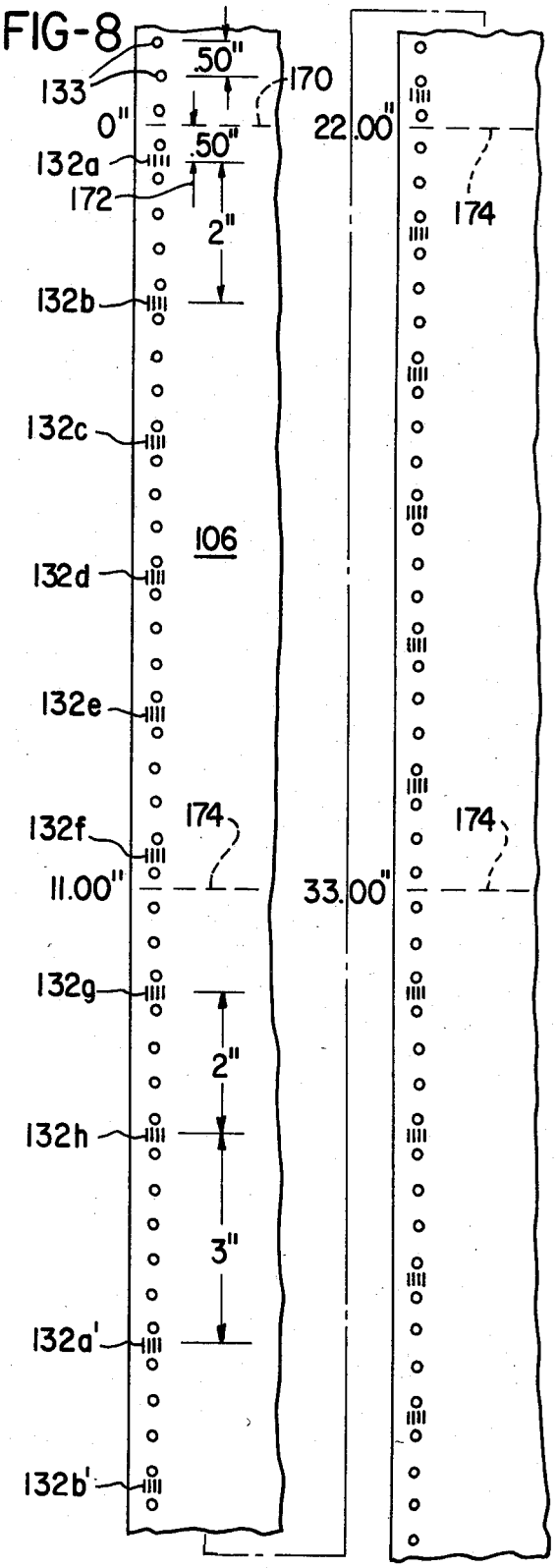
FIG. 8 is a plan view of a portion of a web showing the locations of crimps produced by the holder along a series of 11 inch (27.9 cm) forms.

The crimp pattern produced by blade holder 20 is shown in FIGS. 7 and 8. It will be understood that all spacing dimensions described in connection therewith represent the center-to-center spacings of the items in question. In FIG. 7, a portion of the edge of a web 106 are shown for illustrating the application of the crimps in the case of 8½ inch (21.6 cm) forms. Holes 133 are provided along the edge of web 106, with a spacing of 0.50 inch (1.27 cm) between adjacent holes 133, illustrated by arrows 148. A perforation 150 extends across web 106, centered 0.25 inch (0.635 cm) between adjacent holes 133, defining the division between successive forms. The location of perforation 150 is at a position along web 106 designated, for purposes of discussion, as 0" (0 cm).

The first crimp 132*a* of the crimp pattern is applied to web 106 1.0 inch (2.54 cm) below perforation 150, as indicated by arrow 152. The next succeeding crimps 132*b* and 132*c* are applied to the web with a spacing of 2.0 inches (5.08 cm) from the preceding crimp, indicated by arrows 154. Crimps 132*d* through 132*h* follow in similar fashion.

A perforation 156 defines the beginning of the next succeeding form at a position indicated as 8.50" (21.6 cm), located with a spacing of 0.50 inch (1.27 cm) from crimp 132*e*. Similarly, perforation 158, located at the 17.00" (43.2 cm) position, defines the beginning of the next following form.

At the same time that crimps 132 are being applied to web 106, individual ones of pins 52 engage and disengage holes 133 formed in web 106. It will be recognized from reference to FIG. 5 that, for example, between crimps 132*a* and 132*b*, pins 52 will engage and disengage in particular with those holes designated as 133*p*.

Following the application of crimp 132*h* to web 106, the next succeeding crimp 132*a'* will be produced on web 106 with a spacing of 3.0 inches (7.62 cm) from crimp 132*h*, as indicated by arrows 160. It will be noticed, however, that since eight crimps have already been placed on web 106, corresponding to one for each of the eight crimp blades 22 carried by blade holder 20, the crimp pattern has been begun again. Thus, the crimp pattern demonstrated by crimps 132*a* through 132*a'* will be repeated in similar fashion.

Additional perforations are continuously located on web 106 at 8.50 inch (21.6 cm) intervals. As can be seen from FIG. 7, none of the crimps 132 applied to web 106 will coincide with any of perforations 150, 156, or 158. Moreover, beyond perforation 158, located at the 17.00" (43.2 cm) position along web 106, the next succeeding crimp 132*a'* is located at a spacing from perforation 158 of 1.0 inch (2.54 cm), indicated by arrow 162. It will be seen that this is identical to the spacing between perforation 150 and crimp 132*a*, and thus the entire pattern illustrated by FIG. 7 will be continuously repeated. It can therefore be seen that in no instance will any of crimps 132 coincide with any perforation.

The crimp pattern produced during the manufacture of 11 inch (27.9 cm) forms is shown in FIG. 8. Here, two consecutive sections of the edge of a web 106 are shown, in which holes 133 have been again formed with a spacing between adjacent holes 133 of 0.50 inch (1.27 cm). A perforation 170, located along web 106 at a position arbitrarily designated 0", defines the division between a pair of successive forms. In this case, however, the first crimp 132*a* of the crimp pattern is positioned with a spacing of only 0.50 inch (1.27 cm) from perforation 170, as indicated by arrows 172. As has been previously described, successive crimps 132*b* through 132*h* of the crimp pattern are formed at 2.0 inch (5.08 cm) intervals, with the repetition of the pattern beginning with crimp 132*a'*, which is spaced from crimp 132*h* by 3.0 inches (7.62 cm).

Successive perforations 174 are provided along web 106 at intervals of 11.0 inches (27.9 cm). While in this case, the entire pattern of crimps and perforations will not begin to repeat until the 187.00" (475.0 cm) position (not shown), it should be recognized that all successive crimps are separated by an integral number of inches. Since successive perforations are separated by an integral number of inches, and since the initial crimp 132*a* is separated from perforation 170 by 0.50 inch (1.27 cm), none of crimps 132 will coincide with any of perforations 174. Further, blade holder 20 is thus suitable for use with any form having a length of an integral number of inches, such as 12 inch (30.5 cm) forms.

In using a fingered crimp blade such as blade 22 for the crimping of a multi-layer web, withdrawal of the blade fingers from the web during the crimping operation tends to cause "plucking" of the web. In such a case, withdrawal of the blade fingers from the web causes all or some of the web layers to be lifted upward from their normal path of travel in the region of the newly-formed crimp. This can damage the strength of the crimp, possibly resulting in unwanted separation or improper registration of the various layers of the finished form.

Referring back to FIGS. 2 and 3, plucking is prevented by providing blade holder 20 with a plurality of web stripping members 180 mounted to portion 32 around the fingers of each blade 22 when mounted therein. Members 180 are constructed of a resilient material, preferably molded from a polyurethane material, and include a base portion 182 and an outwardly extending flange portion 184. As best seen in FIG. 3, flange 184 is adapted to surround fingers 26 of blade 22 on three sides thereof, and extends to a normal height even with the outermost tips of fingers 26 when in position on portion 32.

Member 180 is mounted to portion 32 by a pair of buttons 186 which pass through a pair of holes defined in the base 182 of member 180. Buttons 186 are in turn secured within portion 32, and may be formed, for example, by screws driven into the outer surface of portion 32. Because member 180 is constructed of a resilient marerial, it may be mounted to portion 32 by snapping the openings in base 182 over the heads of buttons 186, and may be removed from portion 32 in reverse fashion. Thus, installation and/or replacement are facilitated.

Since the web stripping members are molded as a single piece, they can be manufactured quite inexpensively, thereby making their use practical. Moreover, since installation of buttons 186 onto a blade holder is easily accomplished by driving screws into the holder surface, use of the members 180 with presently-existing blade holders on a retrofit basis can be easily carried out.

Figure 10:
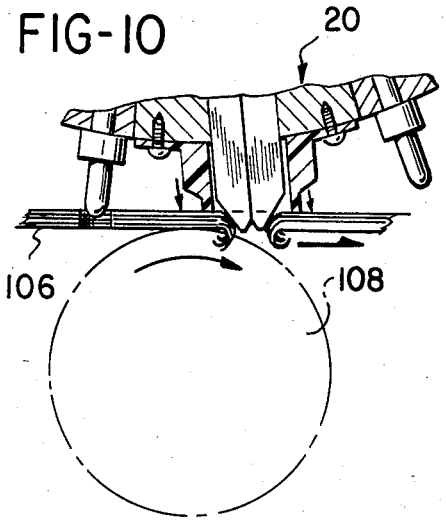
FIG. 10 is a view similar to FIG. 9, further illustrating operation of the web stripping member.
Figure 9:
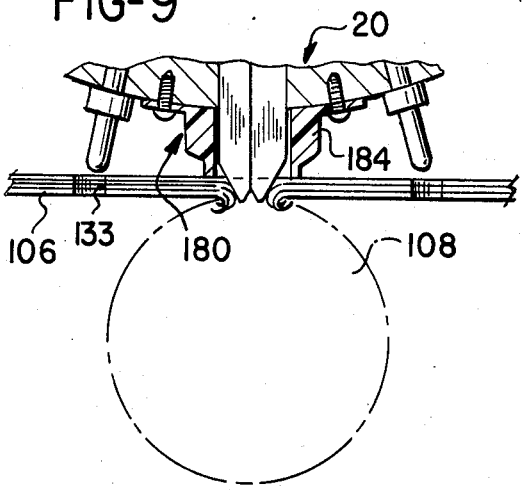
FIG. 9 is a sectional view of a portion of the crimp blade holder, illustrating the operation of a web stripping member.

The operation of web stripping member 180 may be seen by reference to FIGS. 9 and 10. In FIG. 9, the fingers 26 of blade 22 have been inserted through web 106 for crimping thereof. When fingers 26 enter into the grooves within anvil surface member 108, flange 184 of member 180 is compressed between anvil surface member 108 and blade holder 20. In FIG. 10, as rotation of blade holder 20 moves blade 22 and member 180 beyond anvil surface member 108, the resiliency of member 180 causes flange 184 to return to its original height substantially equal to the height of the tips of fingers 26. This resilient force is exerted downwardly upon the web 106, pushing it from engagement with fingers 26, thereby preventing plucking of the web.

Similar web stripping members are disclosed in commonly-assigned U.S. patent application Ser. No. 534,513 filed Sept. 21, 1983 by Stackhouse.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A holder for mounting a plurality of crimp blades for crimping of a moving web, the web having a plurality of holes formed therethrough along a line defined on the web in the direction of movement thereof, each of said holes being separated from the preceding one of said holes by a substantially uniform distance, said holder comprising:

a body having an outer surface;

means for mounting said body to a shaft;

means for securing said body to the shaft such that said body may be axially rotated thereby;

a plurality of crimp blades means for mounting the crimp blades to said body along a circumferential crimp line in predetermined fixed locations with respect to said outer surface such that rotation of said body causes the blades to crimp the web moving therepast;

a plurality of pins;

means mounting said points to said body along said circumferential crimp line such that said pins extend radially from said outer surface, said pin mounting means being configured to cause each of said pins to engage and subsequently disengage one of said holes of the web as said body is rotated and the web is moved therepast.

2. The holder as defined in claim 1 wherein said body is a cylindrical body having a curved outer surface, and wherein said means for mounting said body to the shaft includes an axial hole defined through said cylindrical body.

3. The holder as defined in claim 1 wherein each of said pins includes a first end and a second end, and wherein said pin mounting means includes a plurality of holes defined through said outer surface and radially into said body, each of said holes being of a diameter such that said first end of each of said pins is fitted into said hole, said pin mounting means further including means securing said first end within said hole.

4. Apparatus for crimping of a moving web with a plurality of crimp blades along a line defined thereon in the direction of movement thereof, the web having a plurality of holes formed therethrough along said line, each of said holes being separated from the preceding one of said holes by a substantially uniform distance, said apparatus comprising:

a plurality of crimp blades a holder for mounting the crimp blades including a cylindrical body having a curved outer surface;

an axial bore defined through said cylindrical body for mounting said body to a shaft, and means for securing said holder to the shaft for rotation thereby;

means for mounting the crimp blades to said body along a circumferential crimp line in predetermined fixed locations with respect to said outer surface;

an anvil including a cylindrical anvil body having a curved outer surface;

an axial bore defined through said cylindrical anvil body for mounting said anvil to a second shaft, and means for securing said anvil to the second shaft for rotation thereby;

said anvil body having at least one annular groove defined around said outer surface thereof for receiving the cutting edges of the crimp blades, counter-rotation of said holder body and said anvil body with the moving web therebetween causing insertion of each blade at least partially through the web and into said groove, and subsequent withdrawal of the blade, thereby crimping the web;

a plurality of pins;

means mounting said pins to said holder body along said circumferential crimp line so as to extend radially therefrom; and a plurality of holes defined within said anvil body through said outer surface thereof such that as said holder and said anvil are counter-rotated, each of said pins at least partially engages and subsequently disengages one of said holes;

said mounting means and said anvil body holes being located such that each of said pins further engages and subsequently disengages one of the holes of the web as it moves between said holder and said anvil.

* * * * *